US006921155B2

(12) United States Patent
Sturgeon et al.

(10) Patent No.: US 6,921,155 B2
(45) Date of Patent: Jul. 26, 2005

(54) ELECTRICALLY GROUNDED CONDUCTIVE ESD SHUNT MECHANISM FOR FLUID-EJECTION MECHANISM

(75) Inventors: Scott D. Sturgeon, Vancouver, WA (US); Matt G. Driggers, Vancouver, WA (US); William Eaton, Vancouver, WA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 116 days.

(21) Appl. No.: 10/417,447

(22) Filed: Apr. 16, 2003

(65) Prior Publication Data

US 2004/0207693 A1 Oct. 21, 2004

(51) Int. Cl.[7] ..... B41J 2/05
(52) U.S. Cl. ..... 347/58

(58) Field of Search ..... 347/58, 57, 56, 347/55, 54, 59, 64, 63, 62, 61, 50, 20, 47, 44, 86, 84, 85, 87; 400/196.1

(56) References Cited

U.S. PATENT DOCUMENTS 4,887,921 A * 12/1989 Hayashi et al. ..... 400/196.1
5,365,645 A 11/1994 Walker et al.
6,361,150 B1 * 3/2002 Schulte et al. ..... 347/56

* cited by examiner

*Primary Examiner*—Raquel Yvette Gordon

(57) ABSTRACT

A fluid-ejection mechanism of one embodiment of the invention is disclosed that includes one or more electrical contacts and one or more electrically grounded electrostatic discharge (ESD) shunt mechanisms. The electrical contacts make contact with corresponding contacts of one or more fluid-ejection assemblies that are otherwise exposed. The ESD shunt mechanisms to protect the electrical contacts from ESD when the electrical contacts are exposed.

32 Claims, 4 Drawing Sheets

ELECTRICALLY GROUNDED CONDUCTIVE ESD SHUNT MECHANISM FOR FLUID-EJECTION MECHANISM

BACKGROUND

Inkjet printers have become popular with both home and business users. They have especially proven to be a low-cost way to print color hardcopies of images such as photographs. With the increasing sophistication of inkjet printers, many users, especially home users, concentrate on cost as a significant factor on which to base decisions as to which inkjet printers to purchase.

Inkjet printers, like other electronic devices, are susceptible to electrostatic discharge (ESD). Foreign objects, such as users' fingers, objects such as screwdrivers, and other objects may have a latent electrostatic charge. If they touch an exposed electrical contact of an inkjet printer, the resulting ESD may damage the inkjet printer. Because inkjet printers usually have removable printheads, the printers are especially vulnerable to ESD during printhead removal and insertion.

Integrating ESD protection into electronic devices, such as inkjet printers, can add relatively significant cost to manufacturing the devices. For instance, specific ESD protection circuits may be added to inkjet printers to prevent ESD from damaging the printers. However, the added cost of such ESD protection circuits can be cost prohibitive, especially in the case of consumer inkjet printers, where competition on the basis of price is fierce.

SUMMARY OF THE INVENTION

A fluid-ejection mechanism of one embodiment of the invention includes one or more electrical contacts and one or more electrically grounded electrostatic discharge (ESD) shunt mechanisms. The electrical contacts make contact with corresponding contacts of one or more fluid-ejection assemblies that are otherwise exposed. The ESD shunt mechanisms to protect the electrical contacts from ESD when the electrical contacts are exposed.

BRIEF DESCRIPTION OF THE DRAWINGS

The drawings referenced herein form a part of the specification. Features shown in the drawing are meant as illustrative of only some embodiments of the invention, and not of all embodiments of the invention, unless explicitly indicated, and implications to the contrary are otherwise not to be made.

DETAILED DESCRIPTION OF THE DRAWINGS

In the following detailed description of exemplary embodiments of the invention, reference is made to the accompanying drawings that form a part hereof, and in which is shown by way of illustration specific exemplary embodiments in which the invention may be practiced. These embodiments are described in sufficient detail to enable those skilled in the art to practice embodiments of the invention. Other embodiments may be utilized, and logical, mechanical, and other changes may be made without departing from the spirit or scope of embodiments of the present invention. The following detailed description is, therefore, not to be taken in a limiting sense, and the scope of embodiments of the present invention is defined only by the appended claims.

Fluid-ejection Mechanism with Electrically Grounded Conductive Bias Springs

Figure 1:
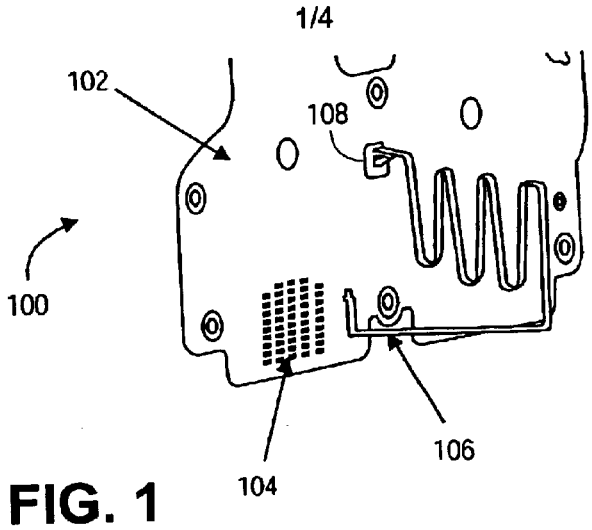
FIG. 1 is a diagram of a perspective view of a partial fluid-ejection mechanism having electrically grounded conductive bias springs, according to an embodiment of the invention.
Figure 2:
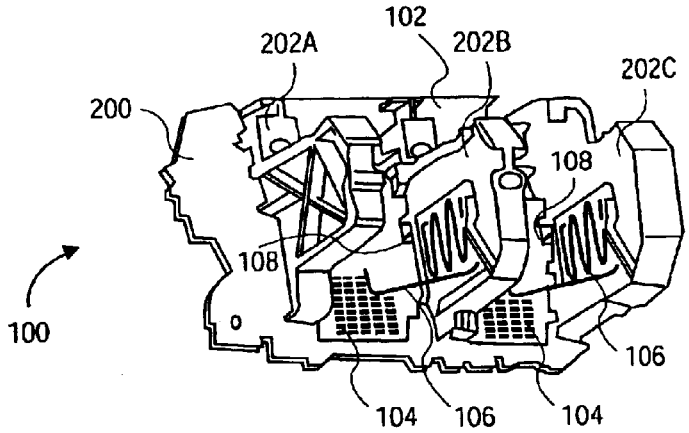
FIG. 2 is a diagram of a perspective view of a fluid-ejection mechanism having electrically grounded conductive bias springs, according to an embodiment of the invention.
Figure 3:
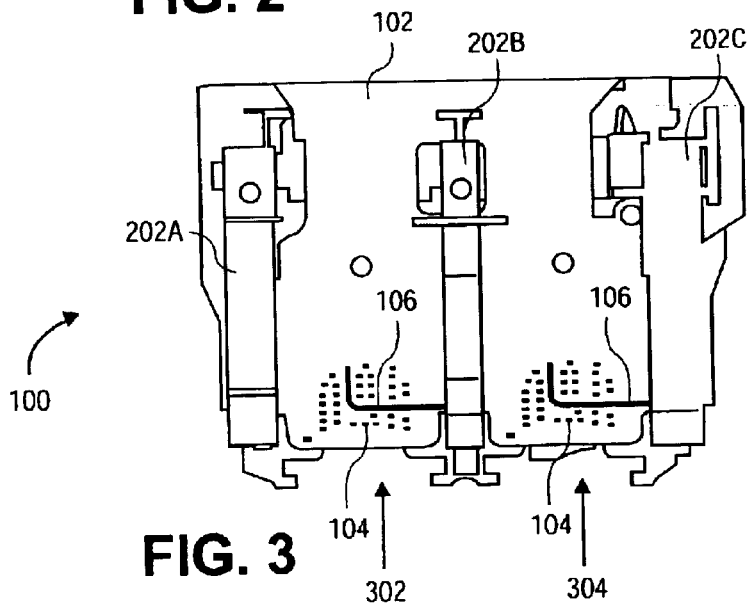
FIG. 3 is a diagram of a top view of a fluid-ejection mechanism having electrically grounded conductive bias springs, according to an embodiment of the invention.

FIGS. 1, 2, and 3 show a fluid-ejection mechanism 100 with electrically grounded conductive bias springs 106, according to an embodiment of the invention. FIG. 1 specifically is a perspective view partially depicting the fluid-ejection mechanism 100. FIG. 2 is a perspective view completely depicting the fluid-ejection mechanism 100. FIG. 3 is a top view of the fluid-ejection mechanism 100. The fluid-ejection mechanism 100 can be an inkjet-printing mechanism, which may be a part of an inkjet-printing device such as an ink-jet printer or a multi-function device (MFD).

In FIG. 1, the fluid-ejection mechanism 100 is depicted as including a circuit board 102, which may be a flexible circuit board, such as a dimpled flexible circuit board. The circuit board 102 includes electrical contacts 104 disposed therein that are intended to make contact with corresponding electrical contacts of fluid-ejection assemblies inserted into the fluid-ejection mechanism 100. The electrical contacts 104 are thus exposed when the fluid-ejection assemblies have not been inserted into the fluid-ejection mechanism. The fluid-ejection assemblies may be inkjet printhead assemblies where the fluid-ejection mechanism 100 is an inkjet-printing mechanism. The circuit board 102 also includes grounding pads 108 situated thereon, which are more generally grounding areas. The grounding pads 108 are grounded to electrical ground.

The conductive bias springs 106, one of which is shown in FIG. 1, have first ends connected to the grounding pads 108, and unconnected second ends, which are preferably not electrically or otherwise physically connected. The conductive bias springs 106 are intended to assist retention of the fluid-ejection assemblies within the fluid-ejection mechanism 100. The conductive bias springs 106 are electrically grounded due to their electrical connection to the grounding pads 108. A foreign object, such as a user's finger, an object such as a screwdriver, or another object that is inserted into the fluid-ejection mechanism 100 is likely to make initial contact, or nearly make initial contact, with the conductive bias springs 106. As such, the conductive bias springs 106 discharge any electrostatic charge on the object safely to the grounding pads 108, protecting the fluid-ejection mechanism 100 from electrostatic discharge (ESD).

For instance, where the foreign object makes actual contact with the conductive bias springs 106, the conductive bias springs 106 discharge any electrostatic charge on the object to the grounding pads 108. As another example, the foreign object may pass close enough to the conductive bias springs 106 that any electrostatic charge on the foreign object arcs therefrom to the conductive bias springs 106. Both of these scenarios are specifically encompassed under the phrase "substantially touching," or "substantially making contact with" the conductive bias springs 106. That is, the phrase substantially touching the conductive bias springs 106, and the phrase substantially making contact with the conductive bias springs 106, is inclusive of the scenario where a foreign object does not actually touch or contact the conductive bias springs 106, but passes close enough to the conductive bias springs 106 that electrostatic charge on the foreign object arcs to the conductive bias springs 106.

Additionally, as can be appreciated by those of ordinary skill within the art, there may be ESD circuits on the circuit board 102, or otherwise on the fluid-ejection mechanism 100, to shunt the ESD that is transferred by the conductive bias springs 106 to the grounding pads 108, and ultimately to ground. Furthermore, whereas FIGS. 2 and 3 show two electrically grounded conductive bias springs 106, in other embodiments there may be more or less of the conductive bias springs 106. The conductive bias springs 106 are also more generally referred to as ESD shunt mechanisms. That is, in other embodiments of the invention, other mechanisms besides conductive bias springs can be employed as ESD shunt mechanisms, such as springs not intended for biasing, electrical conductors that are not meant for biasing and/or are not springs, other types of ESD shunt mechanisms besides conductive bias springs that may or may not be intended for biasing, and so on.

In FIGS. 2 and 3, the fluid-ejection mechanism 100 is depicted as including a carriage assembly 200 from which a number of walls 202A, 202B, 202C protrude at a ninety-degree angle relative to the circuit board 102 disposed within the carriage assembly 200. The walls 202A, 202B, and 202C are collectively referred to as the walls 202, and define two mounting areas 302 and 304 in which the fluid-ejection assemblies are to be inserted. For instance, one of the mounting areas 302 and 304 may be intended for a color inkjet printhead cartridge, whereas the other of the mounting areas 302 and 304 may be intended for a black inkjet printhead cartridge. The carriage assembly 200 is specifically the part of the fluid-ejection mechanism 100 that is receptive to the fluid-ejection assemblies. The carriage assembly 200 thus carries the fluid-ejection assemblies, and may be a stationary or a non-stationary assembly. Whereas FIGS. 2 and 3 show three walls 202 defining two mounting areas 302 and 304, in other embodiments there may be more or less of the walls 202 and the resultantly defined mounting areas.

The conductive bias springs 106, or ESD shunt mechanisms, are situated or positioned within the mounting areas 302 and 304. That is, the conductive bias springs 106 are situated over the electrical contacts 104. Whereas the conductive bias springs 106 are situated in the middle of the electrical contacts 104, from front to back, as depicted in FIGS. 2 and 3, in another embodiment, they, or another type of ESD shunt mechanism, may be situated in front of the electrical contacts 104. When a user inserts fluid-ejection assemblies into the mounting areas 302 and 304, the conductive bias springs 106 are compressed to the right towards the walls 202B and 202C, and thus assist retention of the assemblies within the mounting areas 302 and 304. As has been noted, a user inserting the fluid-ejection assemblies into the mounting areas 302 and 304 is likely to make initial contact with the conductive bias springs 106, as opposed to, for instance, with the electrical contacts 104. As such, electrostatic charge on the user's fingers will likely safely discharge from the conductive bias springs 106 to the grounding pads 108, and not unsafely discharge to the electrical contacts 104.

That is, the conductive bias springs 106 protect against ESD to the electrical contacts 104 when the electrical contacts 104 are exposed, and ESD-causing electrical contact with the circuit board 102, protecting at least the carriage assembly 200 from ESD. For instance, the conductive bias springs 106 may also protect any fluid-ejection assemblies that have already been inserted into one of the mounting areas 302 and 304, such as inkjet printhead assemblies, and so on. More generally, the conductive bias springs 106 are positioned within the carriage assembly 200 such that foreign object penetration, such as a user's fingers, and so on, substantially results in substantial initial contact thereof with the conductive bias springs 106.

Figure 4:
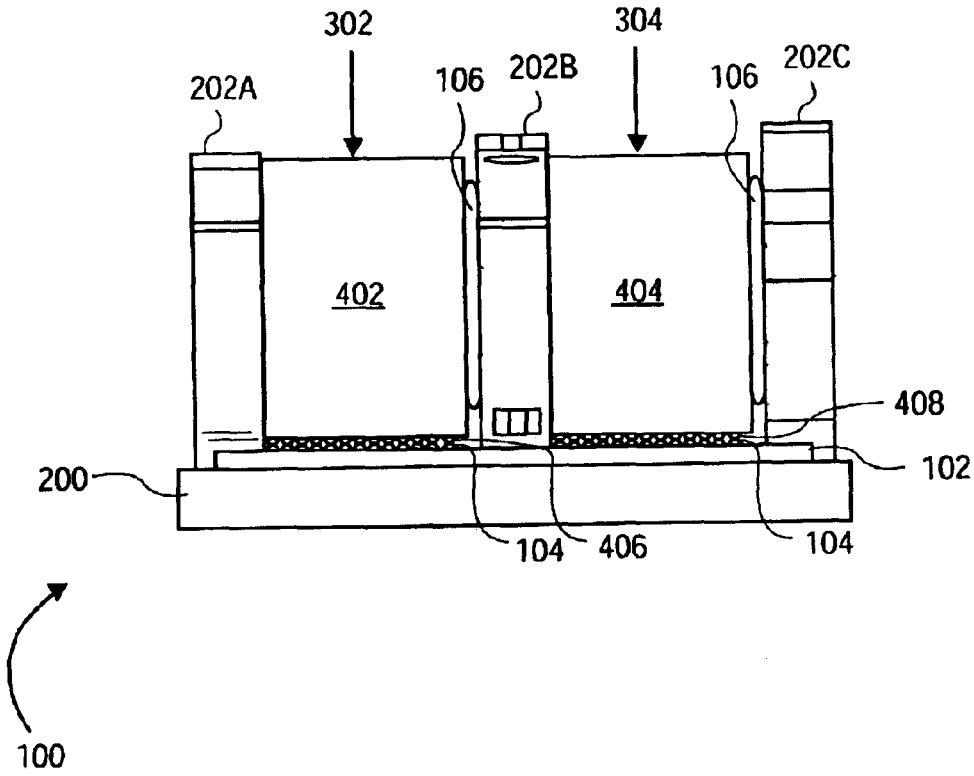
FIG. 4 is a diagram of a side view of a fluid-ejection mechanism in which fluid-ejection assemblies have been inserted, and which has electrically grounded conductive bias springs, according to an embodiment of the invention.

FIG. 4 shows a side view of the fluid-ejection mechanism 100, in which fluid-ejection assemblies 402 and 404 have been inserted, according to an embodiment of the invention. The fluid-ejection assembly 402 has been inserted into the mounting area 302, whereas the fluid-ejection assembly 404 has been inserted into the mounting area 304. The conductive bias springs 106 assist retention of the fluid-ejection assemblies 402 and 404, where retention of the assemblies 402 and 404 may encompass positioning of the assemblies 402 and 404 in one embodiment of the invention, by forcing, or securing, the fluid-ejection assemblies 402 and 404 against the walls 202A and 202B, respectively, and/or against other features of the fluid-ejection mechanism 100. In at least this sense, the springs 106 are bias springs, as they bias the assemblies 402 and 404 against the walls 202A and 202B, respectively. Furthermore, in one embodiment of the invention, the conductive bias springs 106 may also be referred to as simply conductive springs 106. The fluid-ejection assemblies 402 and 404 have electrical contacts 406 and 408, respectively, that are exaggerated in size in FIG. 4 for illustrative clarity. The electrical contacts 406 and 408 make electrical contact with the electrical contacts 104 of the circuit board 102 when the fluid-ejection assemblies 402 have been inserted into the carnage assembly 200. The electrical contacts 104 are also exaggerated in size in FIG. 4 for illustrative clarity.

Method

Figure 5:
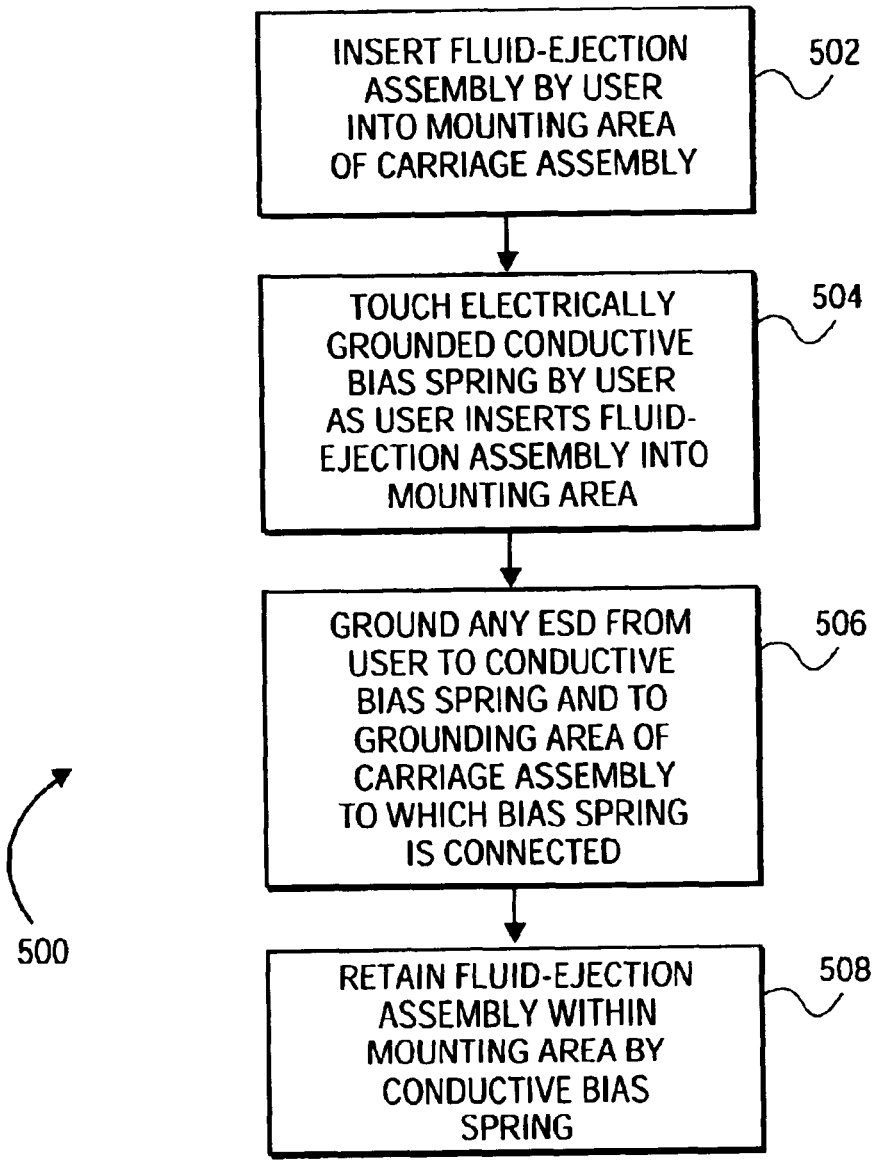
FIG. 5 is a method of an example usage of a fluid-ejection mechanism having electrically grounded conductive bias springs and into which fluid-ejection assemblies are inserted, according to an embodiment of the invention.

FIG. 5 shows a method 500 of an example usage of the fluid-ejection mechanism 100, according to an embodiment of the invention. The method 500 is described in relation to the one of the electrically grounded conductive bias springs 106 that is positioned within the mounting area 302 of the carriage assembly 200, but is applicable to the other of the bias springs 106 that is positioned within the mounting area 304 of the carriage assembly 200 as well. The user inserts the fluid-ejection assembly 402 into the mounting area 302 of the carriage assembly 200 (502). For instance, the user may insert an ink-jet printhead into a mounting area of the carriage assembly of an inkjet printer.

In so doing, the user substantially touches the one of the electrically grounded conductive bias springs 106 that is positioned within the mounting area 302 (504). That is, the user may actually touch one of the bias springs 106, or may nearly but not actually touch one of the bias springs 106, but pass close enough to one of the bias springs 106 such that electrostatic discharge (ESD) arcs from the user to the bias springs 106. Thus, ESD resulting from the user is grounded to this conductive bias spring, and to the one of the grounding pads 108, or areas, to which the bias spring is connected (506). This protects the carriage assembly 200, including the electrical contacts 104 and the circuit board 102 of the carriage assembly 200, as well as fluid-ejection assemblies, including the assembly 402, from the ESD. As has been described, the conductive bias springs 106 are more generally ESD shunt devices, to shunt ESD away from the carriage assembly 200 and to the grounding pads 108. Finally, the conductive bias spring assists retention of the fluid-ejection assembly 402 within the mounting area 302 (508).

Fluid-ejection Device

Figure 6:
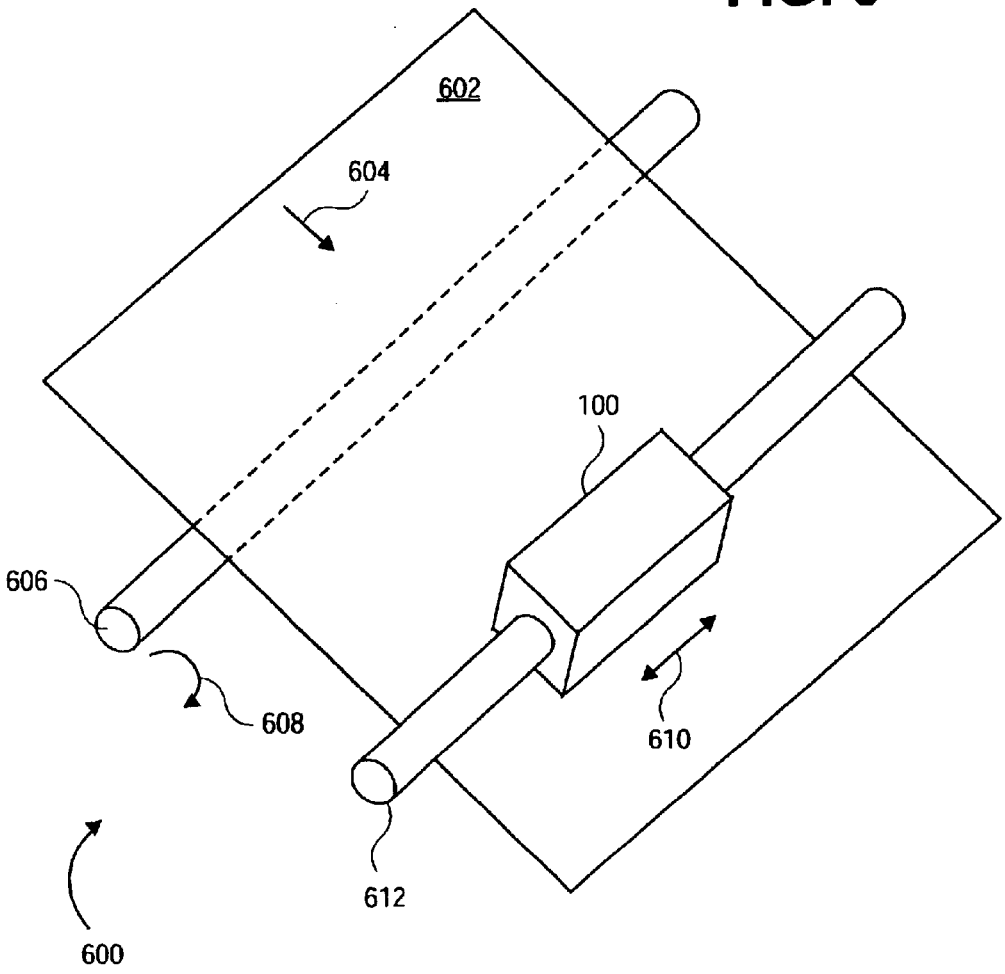
FIG. 6 is a diagram of a fluid-ejection device having a fluid-ejection mechanism with electrically grounded conductive bias springs, according to an embodiment of the invention.

FIG. 6 shows a fluid-ejection device 600, according to an embodiment of the invention. The fluid-ejection device 600 may be an inkjet-printing device, such as an inkjet printer or a multi-function device (MFD) having inkjet-printing functionality. As can be appreciated by those of ordinary skill within the art, the fluid-ejection device 600 may include components in addition to and/or in lieu of those depicted in FIG. 6. A roller shaft 606 is disposed under media 602. The roller shaft 606 rotates in the direction indicated by the arrow 608. This causes the media 602 to move as indicated by the arrow 604.

The fluid-ejection mechanism 100 is depicted in FIG. 6 as an enclosure, but includes the components that have been described as constituent to the fluid-ejection mechanism 100 in the previous sections of the detailed description in conjunction with FIGS. 1–4. The fluid-ejection mechanism 100 is slidably mounted on a shaft 612. That is, the fluid-ejection mechanism is able to move back and forth over the shaft 612, as indicated by the bi-directional arrow 610.

Fluid, such as ink, is ejected by the fluid-ejection mechanism 100 over the portion of the media 602 under the fluid-ejection mechanism 100. The fluid-ejection mechanism 100 moves back and forth as indicated by the bi-directional arrow 610 to eject fluid over the width of the media 602, after which time the media 602 is advanced by the roller shaft 606 in the direction indicated by the arrow 604. The fluid-ejection mechanism 100 is then able to eject fluid over another swath of the media 602, until fluid has been ejected as desired over the entirety of the media 602.

CONCLUSION

It is noted that, although specific embodiments have been illustrated and described herein, it will be appreciated by those of ordinary skill in the art that any arrangement that is calculated to achieve the same purpose may be substituted for the specific embodiments shown. Other applications and uses of embodiments of the invention, besides those described herein, are amenable to at least some embodiments. This application is intended to cover any adaptations or variations of embodiments of the present invention. Therefore, it is manifestly intended that embodiments of the invention be limited only by the claims and equivalents thereof.

We claim:

1. A fluid-ejection mechanism comprising:

one or more electrical contacts to make contact with corresponding contacts of one or more fluid-ejection assemblies insertable into the fluid-ejection mechanism and that are otherwise exposed; and, one or more electrically grounded electrostatic discharge (ESD) shunt mechanisms to protect the electrical contacts from ESD when the electrical contacts are exposed.

2. The fluid-ejection mechanism of claim 1, further comprising a circuit board on which the one or more electrical contacts are disposed.

3. The fluid-ejection mechanism of claim 2, further comprising one or more grounding areas situated on the circuit board to which the ESD shunt mechanisms are electrically connected.

4. The fluid-ejection mechanism of claim 3, wherein the one or more electrically grounded ESD shunt mechanisms comprise one or more electrically grounded conductive bias springs to assist retention of the fluid-ejection assemblies.

5. The fluid-ejection mechanism of claim 4, wherein each conductive bias spring has a first end electrically connected to one of the grounding areas and an unconnected second end.

6. A fluid-ejection mechanism:

a carriage assembly receptive to one or more fluid-ejection assemblies; and, one or more electrically grounded conductive bias springs to assist retention of the fluid-ejection assemblies within the carriage assembly.

7. The fluid-ejection mechanism of claim 6, wherein the carriage assembly comprises a circuit board and a plurality of walls protruding therefrom that define one or more mounting areas for the fluid-ejection assemblies.

8. The fluid-ejection mechanism of claim 7, wherein the circuit board comprises a plurality of electrical contacts to make contact with corresponding electrical contacts of the fluid-ejection assemblies upon insertion of the fluid-ejection assemblies into the carriage assembly.

9. The fluid-ejection mechanism of claim 7, wherein the circuit board further comprises one or more grounding areas to which the conductive springs are electrically connected for grounding.

10. The fluid-ejection mechanism of claim 9, wherein each conductive bias spring has a first end electrically connected to one of the grounding areas and an unconnected second end.

11. The fluid-ejection mechanism of claim 9, wherein the grounding areas comprise grounding pads.

12. The fluid-ejection mechanism of claim 7, wherein each conductive bias spring is positioned within one of the mounting areas.

13. The fluid-ejection mechanism of claim 7, wherein the circuit board is a dimpled flexible circuit board.

14. The fluid-ejection mechanism of claim 6, wherein the fluid-ejection assemblies to which the carriage assembly is receptive are inkjet assemblies and the fluid-ejection mechanism is an inkjet-printing mechanism.

15. The fluid-ejection mechanism of claim 14, wherein the inkjet assemblies comprise inkjet printheads.

16. A fluid-ejection mechanism comprising:

a carriage assembly receptive to one or more fluid-ejection assemblies; and, means for assisting retention of the fluid-ejection assemblies within the carriage assembly and for protecting at least the carriage assembly from electrostatic discharge (ESD).

17. The fluid-ejection mechanism of claim 16, wherein the carriage assembly comprises a circuit board having a plurality of electrical contacts to make contact with corresponding electrical contacts of the fluid-ejection assemblies upon insertion of the fluid-ejection assemblies into the carriage assembly, the means preventing ESD-causing electrical contact with the circuit board.

18. The fluid-ejection mechanism of claim 16, wherein the means comprises one or more electrically grounded bias springs.

19. The fluid-ejection mechanism of claim 16, wherein the means further protects the one or more fluid-ejection assemblies from the ESD.

20. A fluid-ejection device:

a carriage assembly receptive to one or more fluid-ejection assemblies and to move back and forth past media for the fluid-ejection assemblies to eject fluid onto the media; and, one or more electrically grounded conductive bias springs to assist retention of the fluid-ejection assemblies within the carriage assembly and positioned within the carriage assembly such that foreign object penetration into the carriage assembly substantially results in initial contact with the conductive bias springs.

21. The fluid-ejection device of claim 20, wherein the carnage assembly comprises:

a circuit board;

a plurality of walls protruding relative to the circuit board that define one or more mourning areas for the fluid-ejection assemblies, each conductive bias spring positioned within one of the mounting areas;

a plurality of electrical contacts on the circuit board to make contact with corresponding electrical contacts of the fluid-ejection assemblies upon insertion of the fluid-ejection assemblies into the carriage assembly; and, a plurality of grounding pads on the circuit board to which the conductive bias springs are electrically connected.

22. The fluid-ejection device of claim 20, wherein the fluid-ejection assemblies to which the carriage assembly is receptive are inkjet assemblies and the fluid-ejection device is an inkjet-printing device.

23. The fluid-ejection device of claim 22, wherein the inkjet assemblies comprise inkjet printheads.

24. A method comprising:

inserting by a user of a fluid-ejection assembly into a mounting area of a carriage assembly for the fluid-ejection assembly;

substantially touching an electrically grounded electrostatic discharge (ESD) shunt mechanism by the user as the user inserts the fluid-ejection assembly into the mounting area of the carriage assembly; and, grounding electrostatic discharge (ESD) from the user to the ESD shunt mechanism and to a grounding area of the carriage assembly to which the ESD shunt mechanism is electrically connected.

25. The method of claim 24, wherein inserting by the user of the fluid-ejection assembly comprises inserting by the user of an inkjet printhead.

26. The method of claim 24, wherein inserting by the user of the fluid-ejection assembly into the mounting area of the carriage assembly comprises inserting by the user of an inkjet printhead into the mounting area of the carriage assembly of an inkjet printer.

27. The method of claim 24, wherein substantially touching the electrically grounded ESD shunt mechanism by the user comprises the user actually touching the electrically grounded ESD shunt mechanism.

28. The method of claim 24, wherein substantially touching the electrically grounded ESD shunt mechanism by the user comprises the user nearly touching the electrically grounded ESD shunt mechanism.

29. The method of claim 24, wherein substantially touching the electrically grounded ESD shunt mechanism by the user comprises substantially touching an electrically grounded conductive bias spring by the user.

30. The method of claim 29, further comprising assisting retention of the fluid-ejection assembly within the mounting area of the carriage assembly by the conductive bias spring.

31. The method of claim 24, wherein grounding ESD from the user to the ESD shunt mechanism and to the grounding area of the carnage assembly protects the carriage assembly from the ESD.

32. The method of claim 24, wherein grounding ESD from she user to the ESD shunt mechanism and to the grounding area of the carriage assembly protects the fluid-ejection assembly from the ESD.

* * * * *